US005666675A

United States Patent [19]

Rüegg

[11] Patent Number: 5,666,675

[45] Date of Patent: Sep. 16, 1997

[54] FLUSHING MEANS WITH A TOILET BOWL

[75] Inventor: Urs Rüegg, Rapperswil, Switzerland

[73] Assignee: Geberit Technik AG, Jona, Switzerland

[21] Appl. No.: 478,614

[22] Filed: Jun. 7, 1995

[51] Int. Cl.[6] ..... E03D 11/02

[52] U.S. Cl. ..... 4/425; 4/421

[58] Field of Search ..... 4/344, 421–425

[56] References Cited

U.S. PATENT DOCUMENTS

| | | | |
|---|---|---|---|
| 5,054,133 | 10/1991 | Pickerrell et al. | 4/425 |
| 5,515,556 | 5/1996 | Johnson | 4/425 |

FOREIGN PATENT DOCUMENTS

| | | |
|---|---|---|
| 0 352 712 A3 | 7/1989 | European Pat. Off. . |
| 2 241 664 | 3/1975 | France . |
| 36 03 822 A1 | 8/1986 | Germany . |
| WO95/04196 | 2/1995 | WIPO . |

*Primary Examiner*—Charles E. Phillips
*Attorney, Agent, or Firm*—McGlew and Tuttle

[57] ABSTRACT

The flushing means has a flushing tank, which is connected to a flushing channel of a toilet bowl via a flushing elbow and to a nozzle (jet) via a connection pipe. During flushing, part of the flushing water is released from the top into the toilet bowl via the flushing elbow and the flushing channel, and another part is released into the lower area of the toilet via the connection pipe and the nozzle. The flushing water entering the nozzle is taken up by an opening of the connection pipe, which extends into the flushing elbow and is always open. To prevent the connection pipe from being suctioned empty and consequently to prevent the suctioning of a suction siphon from being interrupted, the connection pipe has a hydraulic seal, which hydraulically seals this pipe against a vacuum at the outlet opening of the connection pipe during a suction process. Valves and the like, which are susceptible to the deposition of lime, are not employed.

16 Claims, 4 Drawing Sheets

*Fig. 2*
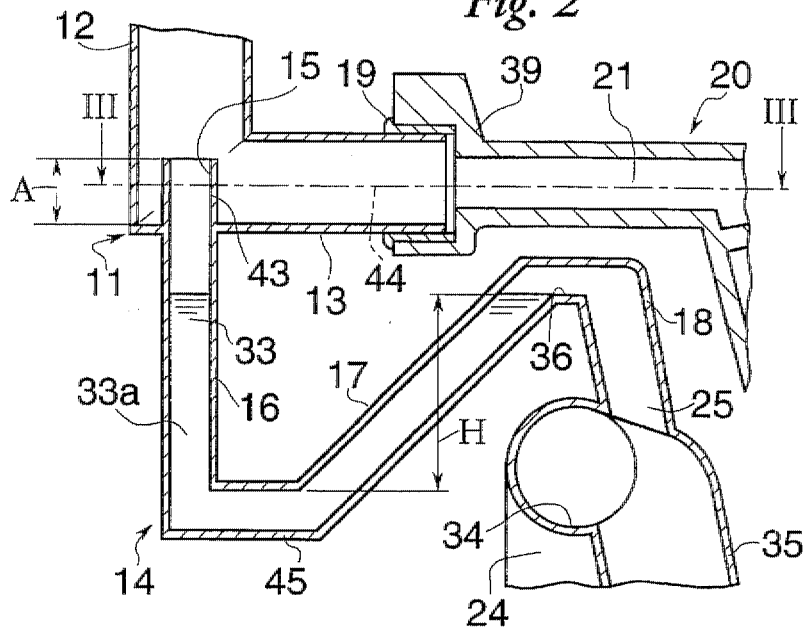
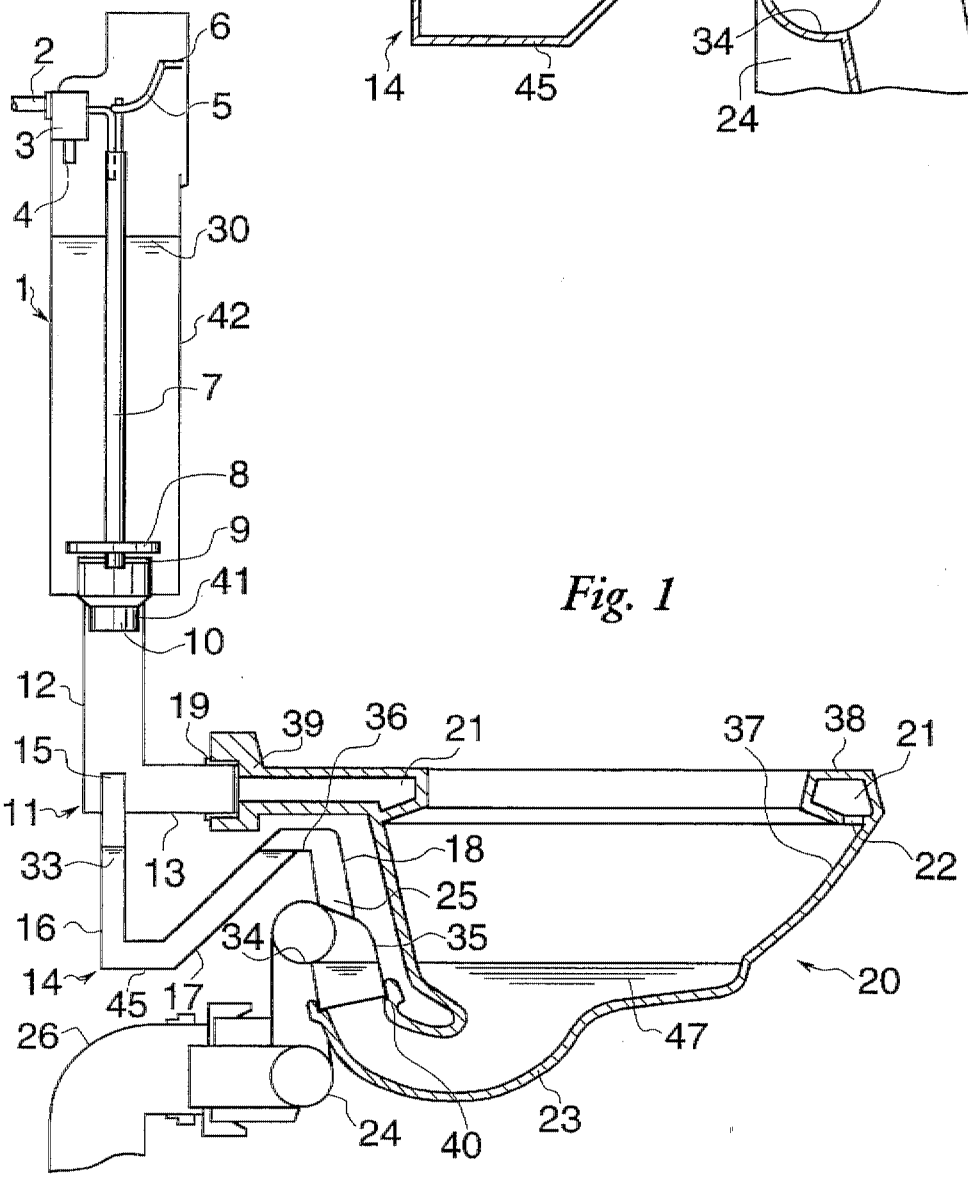
*Fig. 1*

*Fig. 3*
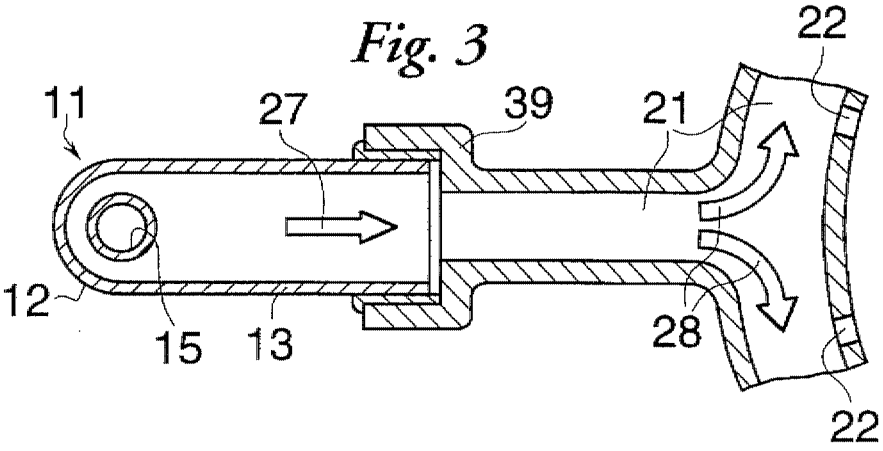
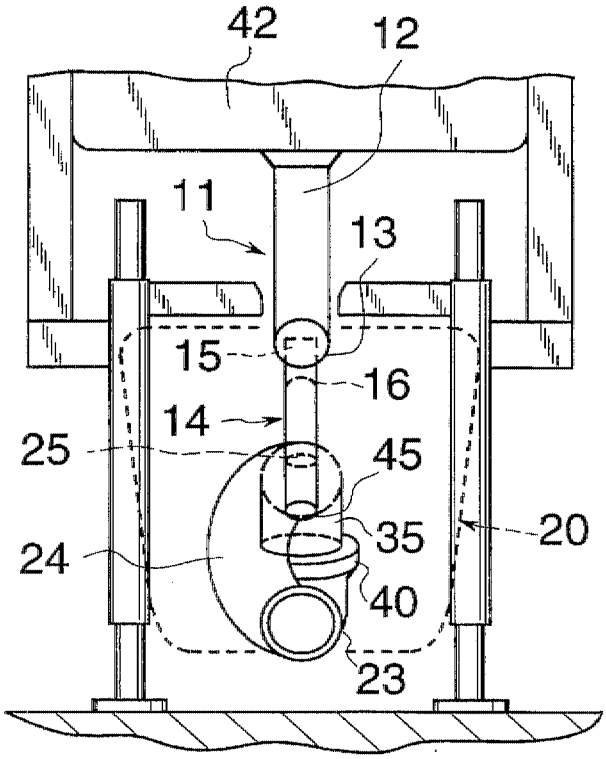
*Fig. 8*

FLUSHING MEANS WITH A TOILET BOWL

FIELD OF THE INVENTION

The present invention pertains to a flushing means with a toilet bowl, which has a flushing channel in an upper edge and a siphon trap at an outlet pipe, which siphon trap is connected to a suction siphon leading to a drain pipe, and with a flushing device to release an amount of flushing water, a part of which can be fed into the toilet bowl via the flushing channel and another part to an outlet opening via a connection pipe.

BACKGROUND OF THE INVENTION

To guarantee at least the following three conditions, approximately 9 L of water are needed for one flushing in the case of the prior-art flushing means with a toilet bowl. First, the inner surface of the toilet bowl shall be cleaned during each flushing. Second, the fetal matter shall be removed into the drain pipe through the soil pipe of the toilet bowl. Third, the siphon trap shall be completely refilled at the end of each flushing. If these conditions were not regularly met, this would lead to unacceptable hygienic conditions and to odor nuisance.

A flushing means of the above-mentioned class, which is said to guarantee flushing with less than 9 L of water, has become known in the state of the art from WO 95/04196. Part of the amount of flushing water is fed in this flushing means to the siphon trap via a so-called jet inlet. Similar means have also become known from FR-A-2 241 664, DE-A-36 03 822 and EP-A-0 352 712. The latter document shows, especially in FIG. 7, a flushing means with a flushing tank, from which water can be fed to a jet inlet arranged in the lower area of the toilet bowl through a connection pipe branched off from the flushing elbow.

SUMMARY AND OBJECTS OF THE INVENTION

The relatively high expense of manufacture is considered to be a disadvantage of the prior-art flushing means. The primary object of the present invention is therefore to provide a flushing means of the class described, which is characterized by a simpler design. This task is accomplished in a means of this class by the connection pipe having a hydraulic seal, which hydraulically seals the connection pipe during the suction process against a vacuum at the outlet opening. This makes it possible to feed water directly to a nozzle or a jet inlet via the connection pipe. Mechanical valves in the connection pipe, which would have to prevent the connection pipe from being suctioned empty during the suctioning of the toilet bowl, are replaced in the flushing means according to the present invention by a hydraulic seal, which can be produced in a very simple manner and also has reduced susceptibility to the formation of lime deposits. Moreover, such a hydraulic seal is highly reliable in operation and requires no maintenance and cleaning.

According to another aspect of the present invention, the task is accomplished by the connection pipe having, on the inlet side, an opening which extends into a flushing elbow and through which opening water can be fed directly from the top to the connection pipe as well as to a hydraulic seal arranged therein. The water may be fed to the opening from, e.g., a flushing tank arranged above this opening at the necessary velocity of flow and under a corresponding pressure. The velocity of flow of the water is hardly reduced by the hydraulic seal, so that it can be released essentially without any loss of energy with the necessary kinetic energy at the end of the connection pipe.

A simple yet reliable division of the flushing water is guaranteed if, according to a variant of the present invention, a flushing elbow has a horizontal arm leading to the flushing channel and a vertical arm leading to the flushing device, and the connection pipe opens into the flushing elbow under the vertical arm. The water flowing from the flushing tank into the flushing elbow is now taken up partially directly by the connection pipe. The rest of the water flows into the flushing channel of the toilet bowl via the horizontal arm. The division of the water can be set in a simple and reliable manner by selecting the size of the opening of the connection pipe. Further advantageous features become apparent from the dependent patent claims, the following specification, as well as the drawing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is a sectional view through a flushing means according to the present invention;

FIG. 2 is a section through part of the means according to FIG. 1;

FIG. 3 is a section along line III—III in FIG. 2;

FIG. 8 is a partial view of the rear side of the means according to the present invention.

DETAILED DESCRIPTION OF THE PREFERRED EMBODIMENT

Figure 4:
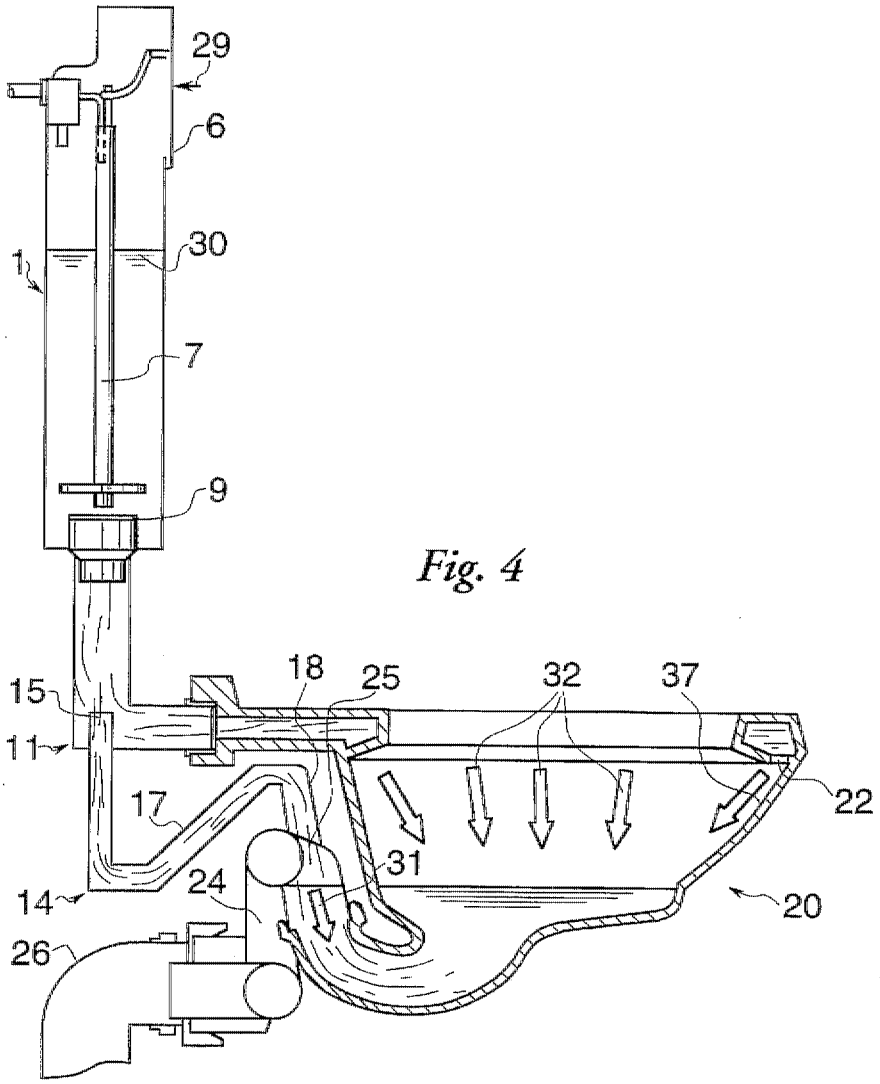
FIGS. 4 through 7 are schematic sectional views showing of the flushing means according to the present invention during different phases of a flushing process.

The flushing means shown schematically in FIG. 1 has a toilet bowl 20 made of, e.g., ceramic, which has, in the usual manner, a siphon trap 23 and, in an upper edge 38, a bowl-flushing channel 21 with a plurality of openings 22 directed toward the inside 37 of the toilet bowl 20. The bowl-flushing channel 21 is connected to a flushing elbow 11 at a connection piece 39 projecting in the rearward direction on the rear side.

A suction siphon 24 (known per se), which has an overflow edge 36 and is connected to a drain pipe 26, is connected to a rearwardly and upwardly directed end 40 of the siphon trap 23. The suction siphon 24 can be recognized in FIG. 8 from the rear side of the means. The suction siphon 24 causes the flushing water present in the siphon trap 23 during the flushing process to be suctioned into the sewer pipe 26, so that the toilet bowl 20 will thus be extensively emptied.

The flushing elbow 11 is tightly connected to the bowl-flushing channel 21 by means of a gasket 19 on a horizontally extending arm 13. An upwardly extending arm 12 of the flushing elbow 11 is also tightly connected to a connection piece 41 of a flushing device 1. The flushing device 1 is a flushing tank in the exemplary embodiment shown. However, a design in which the flushing device is designed differently, e.g., as a flushing valve, is conceivable as well. The connection piece 41 has a downwardly directed opening 10 as well as a valve seat 9, which cooperates with a valve disk 8 of a valve pipe 7. To trigger a flushing, the valve pipe 7 is raised from the position shown by means of, e.g., a pivotable lever 5 of an actuating means 6 in the known manner. Flushing water 30 contained in a container 42 of the flushing device 1 is now released into the flushing elbow 11 through the opening 10 of the connection piece 41. The flushing water 30, which is under the action of gravity, then flows downward in the vertical arm 12. The emptied container 42 is refilled with a prior-art inlet valve 3 (known per se), which is connected to a supply line 2, via an inlet line 43. In addition, water can be released into the flushing elbow 11 through the interior of the valve pipe 7 via another inlet pipe 4.

A connection pipe 14 opens into the flushing elbow 11 from below on the inlet side and into a rising area 35 of the suction siphon 24 from the top on the outlet side. At the end opening into the flushing elbow 11, the connection pipe 14 is open at an upwardly directed opening 15 for directly receiving water from the flushing elbow 11. As is shown especially clearly in FIG. 2, the opening 15 is located at the top end of a pipe section 43, which extends upward to above the central axis 44 of the horizontal arm 13. The pipe section 43 is the upper extension of a vertically extending filling pipe 16 and may be made, together with same, in one piece with the flushing elbow 11. As can be seen, the opening 15 is substantially smaller than the cross section of the vertical arm 12 of the flushing elbow 11.

The filling pipe 16 opens into an obliquely rising pipe 17 at the lower end, in a relatively short horizontal area 45. This rising pipe 17 has an upper seal overflow edge 36, after which an obliquely downwardly directed downpipe 18 is connected to the pipe 14. This downpipe 18 opens with an opening 25 into a rising area 35 of the suction siphon 24. If the connection pipe 14 is filled with water 33 according to FIG. 2, the connection pipe 14 forms a hydraulic seal with the pressure height H. This causes a counterpressure to build up in the case of a vacuum in the opening 25 as the water column 33*a* in the rising pipe 17 drops. The maximum counterpressure is determined by the height of rise H indicated in FIG. 2. The height H is selected to be such that the maximum counterpressure is higher than a vacuum that is maximally expectable at the opening 25. A vacuum at the opening 25 is generated during flushing by the water flowing past the opening 25 in the suction siphon 24. This effect is known per se.

The mode of action of the flushing means according to the present invention will be explained in greater detail below on the basis of FIGS. 1 through 7.

Figure 5:
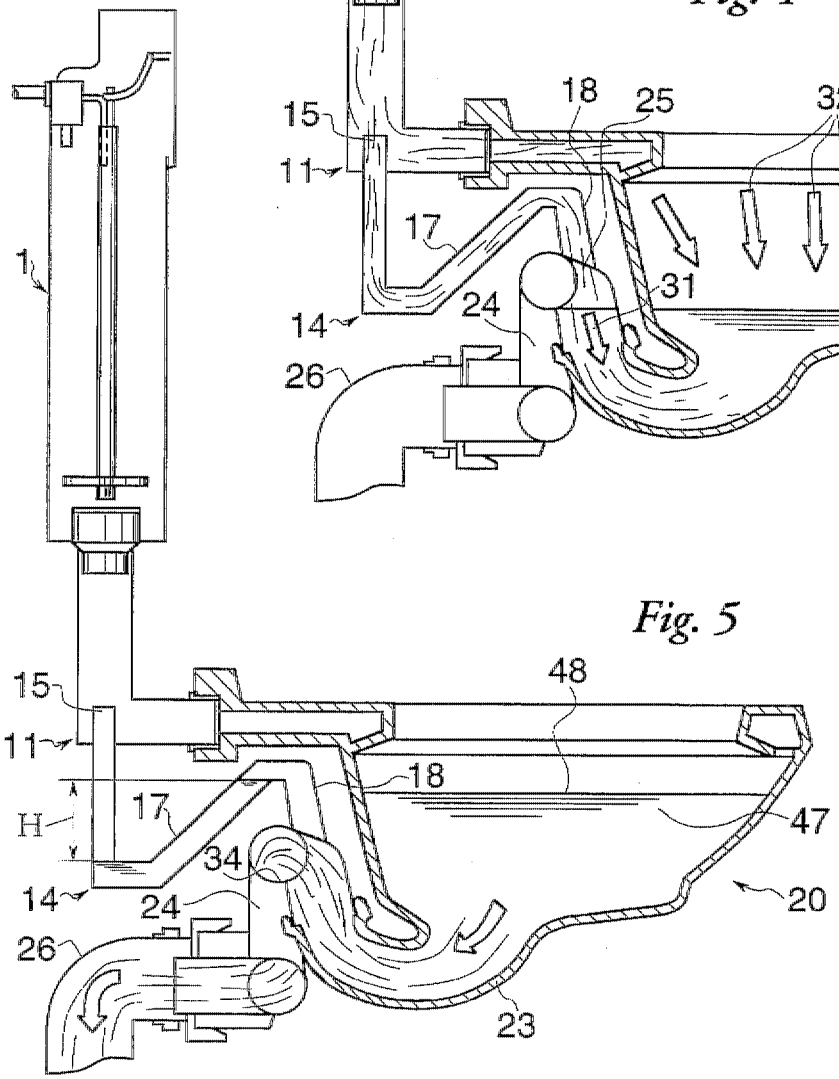

FIG. 1 shows the device in the resting position, in which it is ready for a flushing. The container 42 of the flushing device 1 is filled with, e.g., 9 L of flushing water 30 in this position. The hydraulic seal of the connection pipe 14 is also filled with water 33 up to the overflow edge 36. Finally, the siphon trap 23 is also filled with water 47, which forms a seal against the pipe 26, up to the overflow edge 34 of the suction siphon 24. To trigger a flushing, the actuating means 6 is actuated according to FIG. 4 in the direction of the arrow 29, and the valve pipe 7 is now raised, while the valve opening 9 is opened and flushing water 30 flows through this opening downward into the flushing elbow 11. Part of this downwardly flowing flushing water is sent into the toilet-flushing channel 21 via the horizontal arm 13 according to FIG. 3 in the direction of the arrow 27 and, in the direction of the arrows 28, to the openings 22, where the flushing water flows into the toilet bowl 20 in the direction of the arrows 32 (FIG. 4). The remaining part of the flushing water flows directly through the opening 15 into the connection pipe 14. The percentage of this amount of water is determined by the relative size of the opening 15. The water flowing into the connection pipe 14 flows, together with the water already present in the connection pipe 14, with the exception of a residual amount, into the suction siphon 24 through the opening 25 in the direction of the arrow 31. The water flowing out of the opening 25 in the downward direction brings about a backflow in the water already present in the siphon trap 23. As a result, the level of the water 47 present in the toilet bowl 20 is raised, and its potential energy and consequently its flushing power are thus increased. The inside 37 of the toilet bowl 20 is cleaned at the same time via the bowl-flushing channel 21. The condition shown in FIG. 5 is reached after complete emptying of the flushing tank 1. As can be seen, the level 48 of the water 47 is above the overflow edge 34 of the suction siphon 24. The water 47 present in the toilet bowl 20 and in the siphon trap 23 is suctioned and delivered into the pipe 26 due to the action of the suction siphon 24. Fecal matter is now entrained and also transported into the pipe 26. There is a vacuum inside the downpipe 18 during this suction process, but this vacuum is lower than the counterpressure maximally generated in the rising pipe 17.

Figure 6:
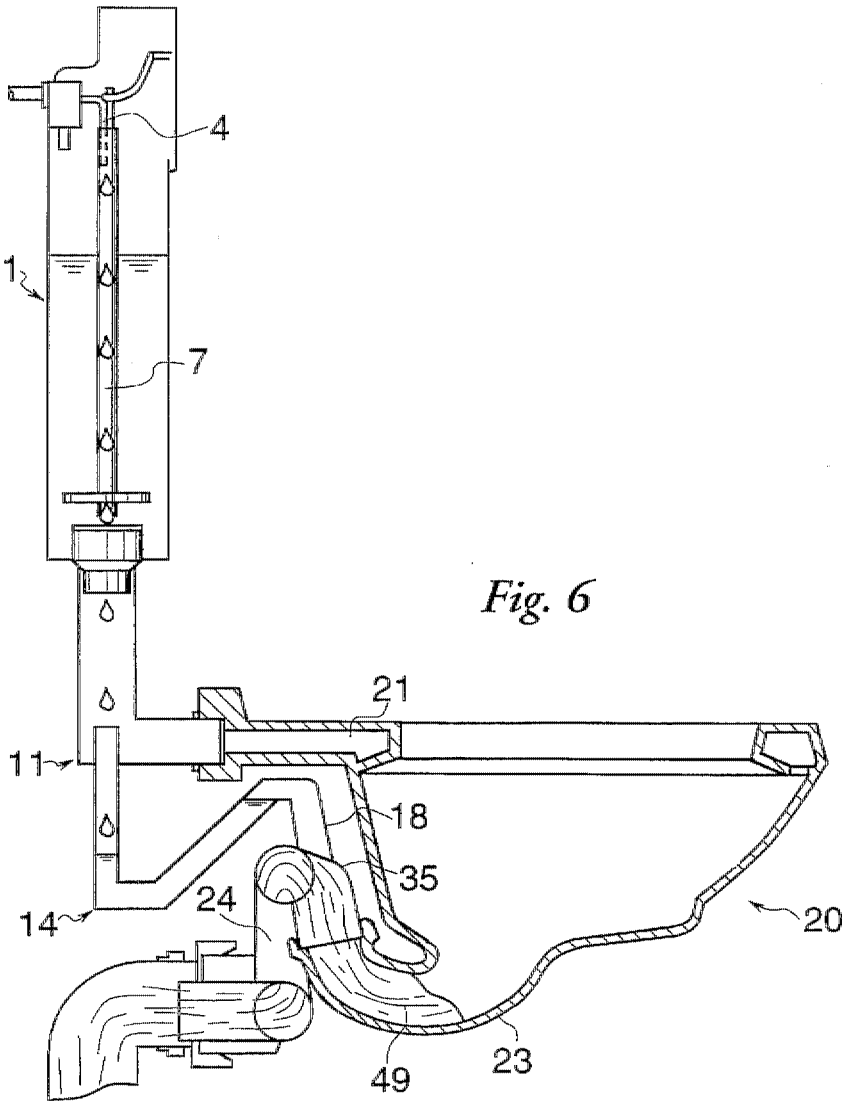
Figure 7:
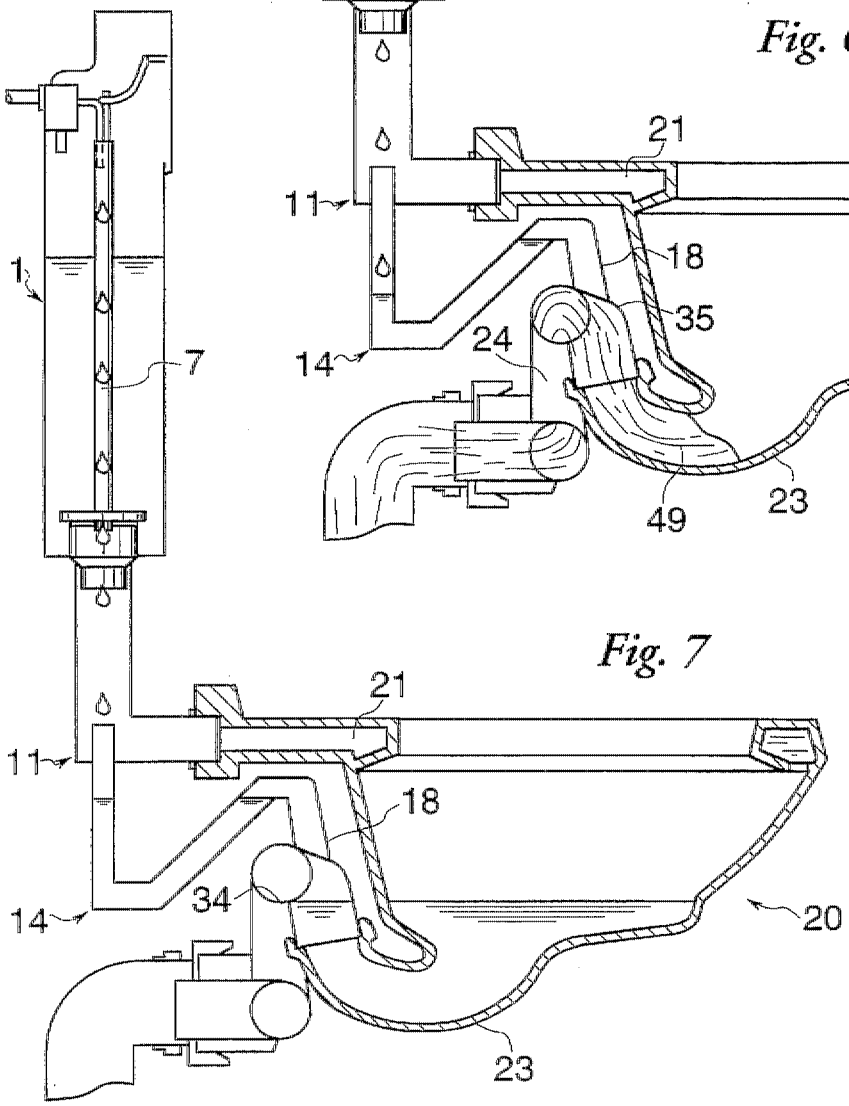

The suction process is completed when the toilet bowl 20 is emptied, according to FIG. 6, except for a residual amount of water 49. The flow in the suction siphon 24 is now interrupted, and water present in the area 35 flows back into the siphon trap 23. To make the flushing device ready for another flushing, water is introduced into the flushing elbow 11 through the hollow valve pipe 7 via pipe 4 according to FIGS. 6 and 7, and this water enters the connection pipe 14 and refills the siphon trap 23 up to the level of the overflow edge 36. The siphon trap 23 may also be refilled via the bowl-flushing channel 21. The amount of water released through the pipe 4 is designed to be such that the starting position shown in FIG. 7, in which the flushing means is ready for another flushing, is eventually reached. The container 42 is refilled at the same time via the pipe 4 along with the refilling of the toilet bowl 20. The device is thus ready for another flushing. It is essential that the refilling of the toilet bowl 20 and the refilling of the container 42 can take place in a relatively short time. As can be clearly recognized from the above explanations, the opening 15 of the connection pipe 14 is continuously open during a flushing as well as during the refilling. No valves or mechanical dosing devices are necessary in the connection pipe 14. Correspondingly, there is also no risk of malfunction of the seal in the connection pipe 14 due to lime deposits. In addition, it is essential that the space requirement for the hydraulic seal as well as for the flushing elbow 11 can be kept very small. Moreover, the pipe 14 as well as the flushing elbow 11 can be manufactured at a very low cost, e.g., as injection moldings.

While a specific embodiment of the invention has been shown and described in detail to illustrate the application of the principles of the invention, it will be understood that the invention may be embodied otherwise without departing from such principles.

What is claimed is:

1. A flushing device with a toilet bowl, comprising:

a flushing channel provided at an upper edge of the toilet bowl;

a siphon trap provided at an outlet pipe, the siphon trap being connected to a suction siphon leading to a drain pipe;

a flushing means for releasing an amount of flushing water, said flushing channel being connected to said flushing means;

a connection pipe connected to said flushing means and connected to an outlet opening of the toilet bowl, said connection pipe having a continuously open connection in communication with said flushing channel; and a hydraulic seal provided in said connection pipe for sealing said connection pipe against a vacuum at said outlet opening, during a suction process of flushing of the toilet bowl.

2. A flushing device according to claim 1, wherein said hydraulic seal is formed as a siphon with said connection pipe having a height of rise designed such that said connection pipe cannot be emptied of said hydraulic seal by a vacuum at the outlet opening, during said suction process.

3. A device according to claim 2, wherein said seal can be filled directly with water from said flushing means, via a pipe section continuously open at a top.

4. A device according to claim 1, wherein said seal can be filled directly with water from said flushing means, via a pipe section of the connection pipe that is continuously open at a top.

5. A device according to claim 4, wherein said pipe section that is open at the top opens in a flushing elbow leading to said flushing channel.

6. A device according to claim 5, wherein said flushing elbow extends essentially horizontally, said pipe section extends into said flushing elbow at least up to a central axis of said flushing elbow.

7. A device according to claim 5, wherein said pipe section has a top opening with an internal diameter which is smaller than an internal diameter of said flushing elbow.

8. A device according to claim 7, wherein said flushing means includes a flushing tank with a valve pipe and a seal above said valve pipe which can be refilled.

9. A device according to claim 1, wherein:

said open connection of said connection pipe is above a bottom of said flushing channel.

10. A device according to claim 1, wherein:

said connection pipe has a seal overflow edge, said open connection of said connection pipe being positioned above said seal overflow edge.

11. A flushing device with a toilet bowl, comprising:

a flushing channel extending into an upper edge of the toilet bowl;

a siphon trap at an outlet of the toilet bowl, the siphon trap being connected to a suction siphon leading to a drain pipe;

flushing means for releasing an amount of flushing water;

a connection pipe connected between said flushing device and an outlet opening of the toilet bowl, one portion of the flushing water being fed into said toilet bowl via said flushing channel and another portion of said flushing water being fed directly into said connection pipe and then directly into said outlet opening;

a flushing elbow connected between said flushing means and said flushing channel, said connection pipe including an intake opening extending into said flushing elbow, said intake opening of said connection pipe being continuously open; and a hydraulic seal disposed in said connection pipe.

12. A device according to claim 11, wherein:

said seal can be directly filled from said flushing means.

13. A device according to claim 11, wherein:

said open connection of said connection pipe is above a bottom of said flushing channel.

14. A device in accordance with claim 11, wherein:

said connection pipe has a seal overflow edge, said open connection of said connection pipe being positioned above said seal overflow edge.

15. A device according to claim 11, wherein said flushing elbow includes a horizontal arm leading to said flushing channel and a vertical arm leading to said flushing means, said connection pipe opening into said flushing elbow under said vertical arm.

16. A device according to claim 15, wherein said opening of said connection pipe is substantially smaller than a cross-section of said vertical arm of said flushing elbow.

* * * * *